US008550307B2

(12) United States Patent
Bunoz et al.

(10) Patent No.: US 8,550,307 B2
(45) Date of Patent: Oct. 8, 2013

(54) DISPENSING DEVICE WITH A DISPOSABLE PUMP

(75) Inventors: Etienne Bunoz, Hailsham (GB); Jeremy Rossall, East Preston (GB); Caryi Kwong, Kwai Chung (HK)

(73) Assignee: Brightwell Dispensers Limited, Newhaven (GB)

( * ) Notice: Subject to any disclaimer, the term of this patent is extended or adjusted under 35 U.S.C. 154(b) by 77 days.

(21) Appl. No.: 13/064,573

(22) Filed: Mar. 31, 2011

(65) Prior Publication Data

US 2012/0248148 A1 Oct. 4, 2012

(51) Int. Cl.
*B67D 7/06* (2010.01)

(52) U.S. Cl.
USPC ..... 222/181.3; 222/190

(58) Field of Classification Search
USPC ..... 222/181.3, 190, 181.1
See application file for complete search history.

(56) References Cited

U.S. PATENT DOCUMENTS

| | | | | |
|---|---|---|---|---|
| 4,324,348 | A | 4/1982 | Johnson et al. | |
| 5,067,635 | A * | 11/1991 | Thomsen | 222/103 |
| 5,791,525 | A * | 8/1998 | Fan | 222/181.3 |
| 5,842,609 | A * | 12/1998 | Higgins et al. | 222/181.3 |
| 6,575,335 | B2 * | 6/2003 | Lewis et al. | 222/156 |
| 7,051,903 | B2 | 5/2006 | Lewis et al. | |
| 7,086,567 | B1 * | 8/2006 | Ciavarella et al. | 222/95 |
| 8,091,738 | B2 * | 1/2012 | Ciavarella | 222/181.3 |
| 8,313,010 | B2 * | 11/2012 | Quinlan et al. | 222/190 |
| 2005/0133526 | A1 * | 6/2005 | Lewis et al. | 222/1 |
| 2005/0258192 | A1 | 11/2005 | Matthews et al. | |
| 2006/0213929 | A1 * | 9/2006 | Ophardt et al. | 222/180 |
| 2008/0023487 | A1 * | 1/2008 | Douwes | 222/105 |
| 2008/0083786 | A1 * | 4/2008 | Marin | 222/181.3 |
| 2009/0212073 | A1 * | 8/2009 | Haworth | 222/181.3 |
| 2012/0111891 | A1 * | 5/2012 | McNulty et al. | 222/181.3 |

FOREIGN PATENT DOCUMENTS

| | | |
|---|---|---|
| EP | 0 019 582 | 11/1980 |
| EP | 0 392 238 | 10/1990 |
| EP | 1 118 389 | 7/2001 |
| EP | 2 080 464 | 7/2009 |
| FR | 2 641 337 | 7/1990 |
| GB | 2 155 435 | 9/1985 |
| GB | 2472235 | 2/2011 |
| WO | WO 2011/012836 | 2/2011 |

* cited by examiner

*Primary Examiner* — Paul R Durand
*Assistant Examiner* — Donnell Long
(74) *Attorney, Agent, or Firm* — Levy & Grandinetti

(57) ABSTRACT

A dispensing device comprising an enclosure and a pump, in which the enclosure comprises a base and a cover, in which the cover is attached to the base with a hinge and is rotatable about said hinge towards and away from said base, in which the pump comprises an operating plunger, in which the cover is connected to said plunger by a pivoting linkage adapted to convert the rotational movement of the cover into a linear movement of the operating plunger.

19 Claims, 9 Drawing Sheets

48
45
6
1
2
5
47
4
44
3
8
7
46
49

47
5
1
45
50
4
44
49
53
15
39
52
3
46
39

DISPENSING DEVICE WITH A DISPOSABLE PUMP

This invention relates to a dispensing device with a disposable pump, for use particularly, but not exclusively, to dispense soap or cleaning fluids as a foam, liquid or spray.

Soap dispensers and the like are well known. They commonly comprise an enclosure which contains a pump, to which is mounted a replaceable container of fluid to be dispensed. The pump has a plunger part, depression of which forces an associated piston to perform a dispensing stroke. In some examples the enclosure comprises a cover attached to a base in a hinged arrangement, and movement of the cover acts to depress the plunger part and force the piston to perform a dispensing stroke. Known pumps are provided with a spring return means, which forces the pump to perform a priming stroke after a dispensing stroke has been performed. The spring return means can comprise an internal coil spring which acts directly on a part which is integral to the piston. This arrangement is advantageous because users need only press on the cover to obtain liquid from the dispenser, and the pump will automatically perform its priming stroke, and return the cover to a start position.

The cover is not directly connected to the plunger part, rather these parts simply bare against one another during the dispensing and priming strokes. This is an advantageously simple arrangement because the rotational movement of the cover is different to the linear movement of the piston, and any connection between these two parts would have to address that issue. In addition, the covers are releasable from the bases to allow access to the interior of the dispenser in order to replace spent containers of fluid. Any direct connection between the cover and the plunger part would obstruct such functionality. In essence, incorporating the spring return means into the pump and allowing the plunger part to simply push the cover back out during the priming stroke is the best solution.

In known dispensers the pump is an permanent part thereof, and is robustly constructed to ensure a long lifespan. This requirement for longevity, combined with the need for an internal spring return means, results in the pumps being relatively complex and expensive to manufacture. In contrast the containers of fluid are relatively simple in construction as they are intended to be disposable. They merely comprise a bag or cartridge provided with a connector part to affix them to the pump.

The present invention is intended to address some of the above problems and to provide a new approach.

Therefore, according to the present invention, a dispensing device comprises an enclosure and a pump, in which the enclosure comprises a base and a cover, in which the cover is attached to the base with a hinge and is rotatable about said hinge towards and away from said base, in which the pump comprises an operating plunger, in which the cover is connected to said plunger by a pivoting linkage adapted to convert the rotational movement of the cover into a linear movement of the operating plunger.

Thus, the present invention is different to known dispensing devices because the cover is directly connected to the plunger. The has been done so movement of the cover in both an inward and an outward direction will move the plunger in both the dispensing and priming strokes respectively. This has been done so a pump can be used which is not provided with a spring return means, and instead that feature can be provided elsewhere on the dispenser. The purpose of this arrangement is to reduce the complexity of the pump, as it is now desired to produce a dispenser without a permanent pump, and to provide containers of fluid to be dispensed which have their own integral disposable pumps. It is desirable for a disposable part to be as simple and inexpensive as possible, and removing the spring return means therefrom helps to achieve that goal.

In a preferred construction the pivoted linkage can comprise a track and a sliding member disposed in said track and adapted to slide back and forth therein according to the rotational movement of the cover. The track can be provided on the plunger and the sliding member can be provided on the cover, but preferably the cover can comprise said track and the plunger can comprise said sliding member.

The track can define a straight path, but be curved in a plane normal to said path. With this construction the angle between the track and the sliding member can remain constant as the angle of the cover changes during rotation. This keeps friction between the track and the sliding member to a minimum.

The sliding member can be releasably disposed in said track. This allows the cover and the plunger to be disengaged so the cover can be removed from the base for loading and unloading of containers of fluid to be dispensed.

Any known shape of track and sliding member can be employed here, but in a preferred construction the sliding member can be substantially ball-shaped, and the track can comprise a substantially annular cross-section adapted to retain the sliding member therein.

A piston of said pump can be provided at an inner end of the operating plunger, and a centre of the sliding member can be aligned with an axis of the piston. The sliding member can comprise a hollow partial-sphere which can be delimited by a plane normal to the piston axis. Further, the sliding member can comprise a plurality of circumferentially extending intervals parallel to the piston axis. The delimiting of the sphere at one end, and the intervals provided therein, render the sphere resilient and allow it to be forced into and out of engagement with the track.

As referred to above, the pump can be connected to a container of fluid to be dispensed which can be mounted in the enclosure, and the pump can be releasably mounted to said base.

The pump can be mounted to the base in any known way, for example with a resilient snap-fit arrangement, or with spring-loaded catches. However, in a preferred construction the base can comprise an annular mounting socket, and the pump can comprise an annular mounting boss removably disposed in said mounting socket. The mounting socket can comprise one or more axially extending and open-ended slots, and the mounting boss can comprise one or more corresponding radially extending pins disposed in said slots. A rotatable locking ring can be mounted around the mounting socket, and be provided with one or more L-shaped slots comprising an open-ended axially extending inlet portion and a circumferentially extending lock portion. In an open position said inlet portions can be aligned with the slots of the mounting socket, and in a locked position the lock portions can be aligned with the slots of the mounting bracket. The locking ring can be spring loaded against movement into the open position. This construction is similar to a bayonet fitting, but with the locking ring being the part which rotates and is spring loaded to secure the boss in the socket.

Preferably the base can comprise a spring slot disposed radially of the mounting socket, and the locking ring can comprise a radially extending leaf spring portion, an end of which can be mounted in said spring slot, thereby to bias the locking ring against movement into the open position. The locking ring comprises an activation tab to facilitate its ready rotation in use.

In one construction the base of the mounting socket can comprise a first shaped profile, and the mounting boss can comprise a corresponding second shaped profile adapted to interface with the first shaped profile. This feature can be employed to differentiate between different types of fluid to be dispensed, with only containers of the correct fluid being mountable to a particular base. It can also be used to prevent unauthorised third party containers from being mounted to the base.

The shaped profiles can be any shapes which co-operate with one another, however in a preferred embodiment the first shaped profile can comprise a plurality of studs, the length of each of which is a part of a pre-determined distance, and the second shaped profile can comprise a plurality of corresponding studs, the length of each of which comprises the corresponding remaining part of said pre-determined distance. Therefore, only a mounting boss with the correct formation and height of studs can be mounted to any given base. Where two aligning studs are both greater than half of the pre-determined distance the pins of the mounting boss will not be able to enter the slots on the mounting socket sufficiently to align with the lock portions of the slots of the locking ring, and it would not be possible to secure the mounting boss in place.

As referred to above, the pump is not provided with spring return means. Such means can be provided anywhere on the dispenser, for example as a part of the hinge which connects the cover to the base. However, in a preferred construction the base can be provided with spring-return means comprising a pair of spring-loaded plungers arranged on either side of the pump.

The base and cover can be formed in any known shape, but preferably the base can comprise a back plate with a top edge and a bottom edge, and the cover can comprise a face side with a top side, bottom side, left side and right side extending substantially normally therefrom. The hinge can attach the cover to the top edge of the base adjacent to the top side of the cover. The bottom side of the cover can comprise one or more catches, and the base can comprise one or more corresponding spring-loaded latches adjacent its bottom edge adapted to releasably retain said catches when the cover reaches an outermost point of rotation, corresponding to a primed position of the pump. This construction allows the cover to rotate back and forth between said outermost point of rotation and an innermost point, which movement corresponds to the dispensing and priming strokes of the pump.

The spring loaded latches can be provided as part of a latch body retained in a framework provided in a chamber in said base. The latch body can comprise a bifurcated leaf spring comprising a pair of leaf spring members, ends of which abut against a top wall of said chamber. As such, the latches are spring loaded against being moved into a catch releasing position. The latch body can comprise an operating trigger, depression of which forces the leaf spring members to move apart by sliding across the top wall, and which moves the latches into a catch releasing position. This allows the cover to rotate fully away from the base, in order to provide access to the interior of the dispenser.

The dispenser can be adapted to dispense fluid in any of the known ways. As such the pump can be a foam pump adapted to mix air and fluid together to form a foam, a liquid pump adapted to dispense a liquid, or a liquid spray pump adapted to dispense said liquid as a spray. The manner in which such dispensing actions are achieved is generally known.

An embodiment of the invention will now be described by way of example, and with reference to the accompanying drawings, in which.

Figure 1:
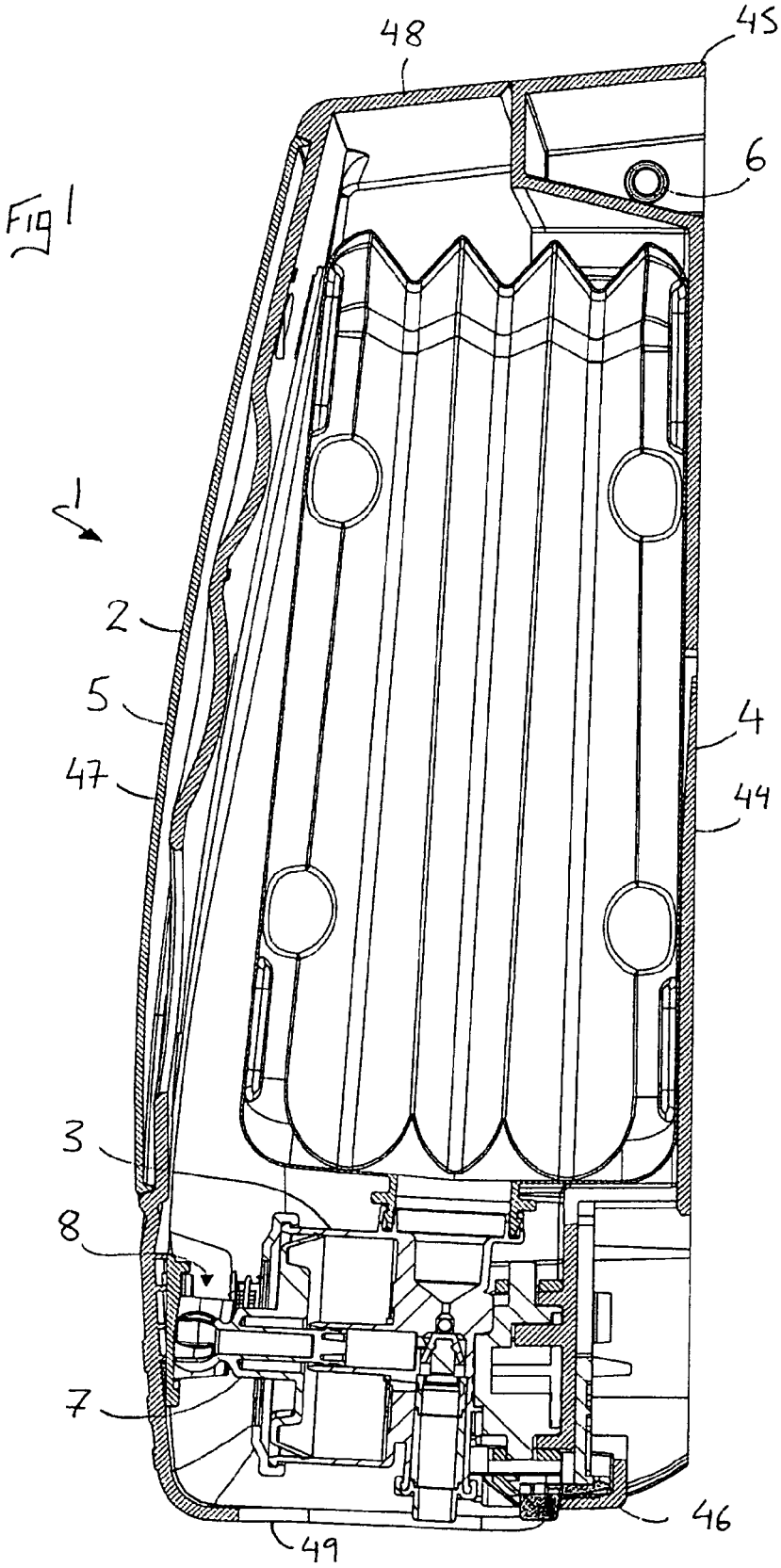
FIG. 1 is a cross-sectional side view of a dispensing device according to the present invention.

As shown in FIG. 1, a dispensing device 1 comprises an enclosure 2 and a pump 3. The enclosure 2 comprises a base 4 and a cover 5. The cover 5 is attached to the base 4 with a hinge 6 and is rotatable about said hinge 6 towards and away from the base 4, as explained further below. The pump 3 comprises an operating plunger 7, and the cover 5 is connected to said plunger 7 by a pivoting linkage 8 adapted to convert the rotational movement of the cover 5 into a linear movement of the operating plunger 7.

Figure 2:
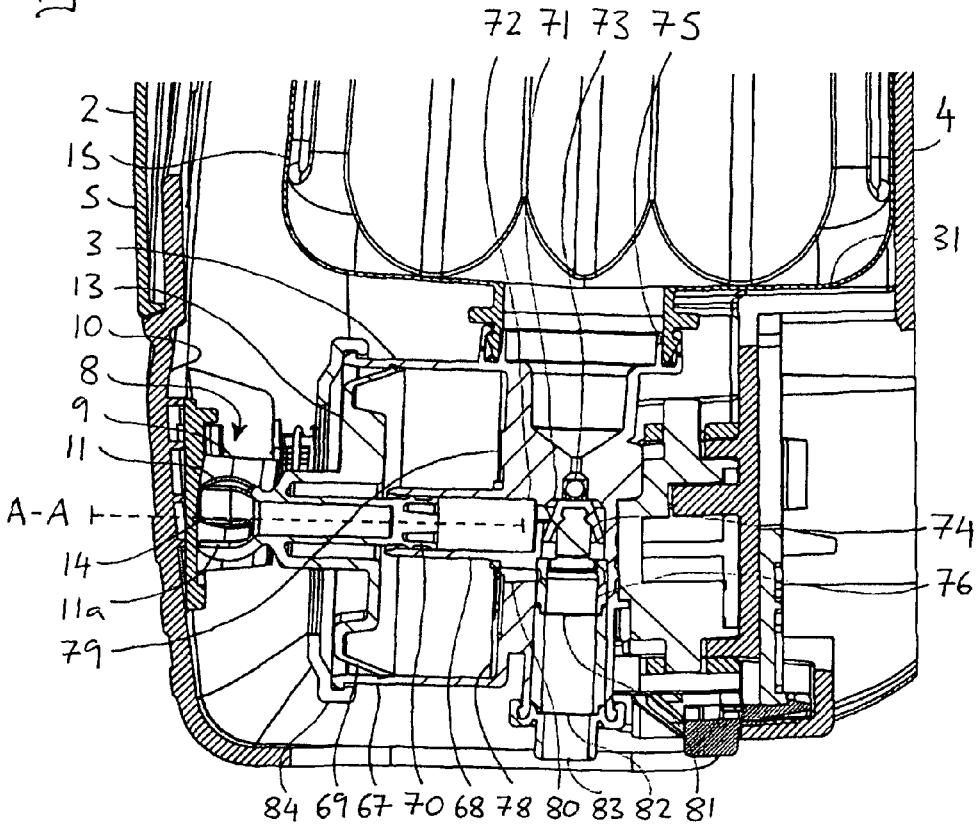
FIG. 2 is a cross-sectional side view of a portion of the dispensing device shown in FIG. 1 in a first configuration.

Referring now to FIG. 2, the pivoting linkage 8 comprises a track 9 provided on an inside surface 10 of the cover 5, and a sliding member 11 provided at an outer end 12 of the operating plunger 7. The track 9 has an annular cross-section, and the sliding member 11 comprises a hollow partial-sphere releasably disposed in said track 9, and adapted to slide back and forth therein according to the rotational movement of the cover 5.

The track 9 defines a straight path, but as is clear from FIG. 2 it is curved in a plane normal to said path. With this construction the angle between the track 9 and the sliding member 11 remains constant as the angle of the cover 5 changes during rotation. This keeps friction between the track 9 and the sliding member 11 to a minimum.

The operating plunger 7 is connected to a piston 13 of the pump 3, and the piston 13 has an axis A-A along which it moves. As is clear from FIG. 2 a centre of the sliding member 11 is aligned with the axis A-A of the piston 13. As such, the linear movement of the sliding member 11 in use is transmitted to the piston 13.

Figure 5:
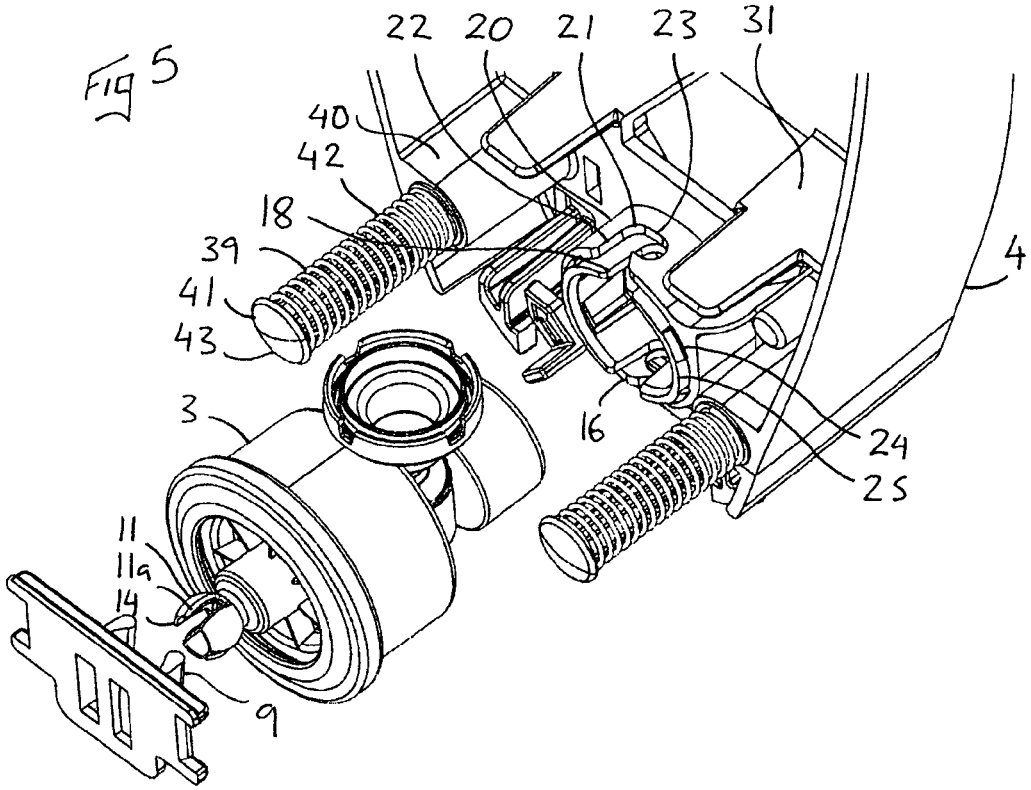
FIG. 5 is an exploded perspective view of a portion of the dispensing device shown in FIG. 1.

The sliding member 11 has a resilient construction to allow it to be compressed so it can be snap-fitted in and out of the track 9. This is achieved by providing the sliding member 11 with three circumferentially extending intervals 11*a* parallel to the piston axis A-A, and delimiting the sliding member 11 at its outer end 14 in a plane normal to the piston axis A-A. This is most clearly seen in FIG. 5.

The pump 3 is connected to a container of fluid 15 to be dispensed, which is mounted in the enclosure 2, and the pump 3 is releasably mounted to the base 4.

Figure 6:
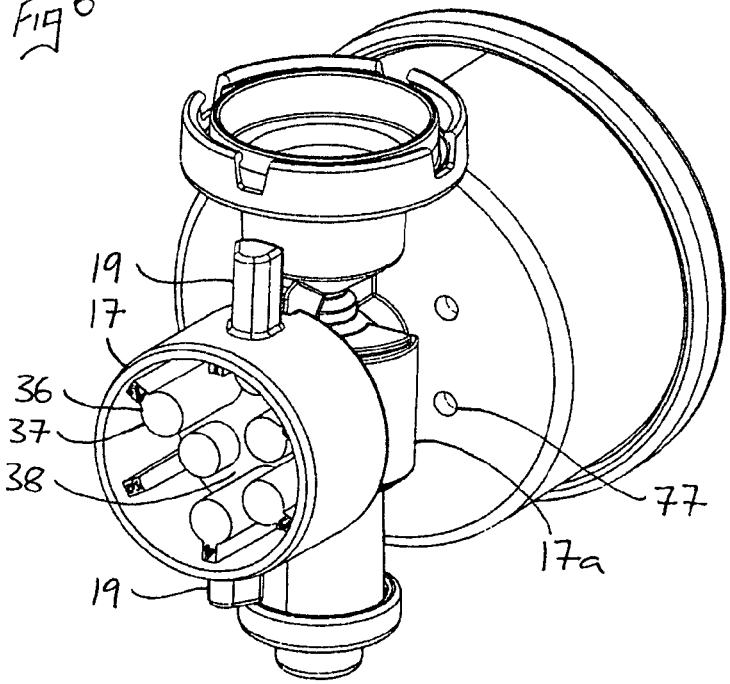
FIG. 6 is a perspective view of a pump component of the dispensing device shown in FIG. 1.
Figure 7:
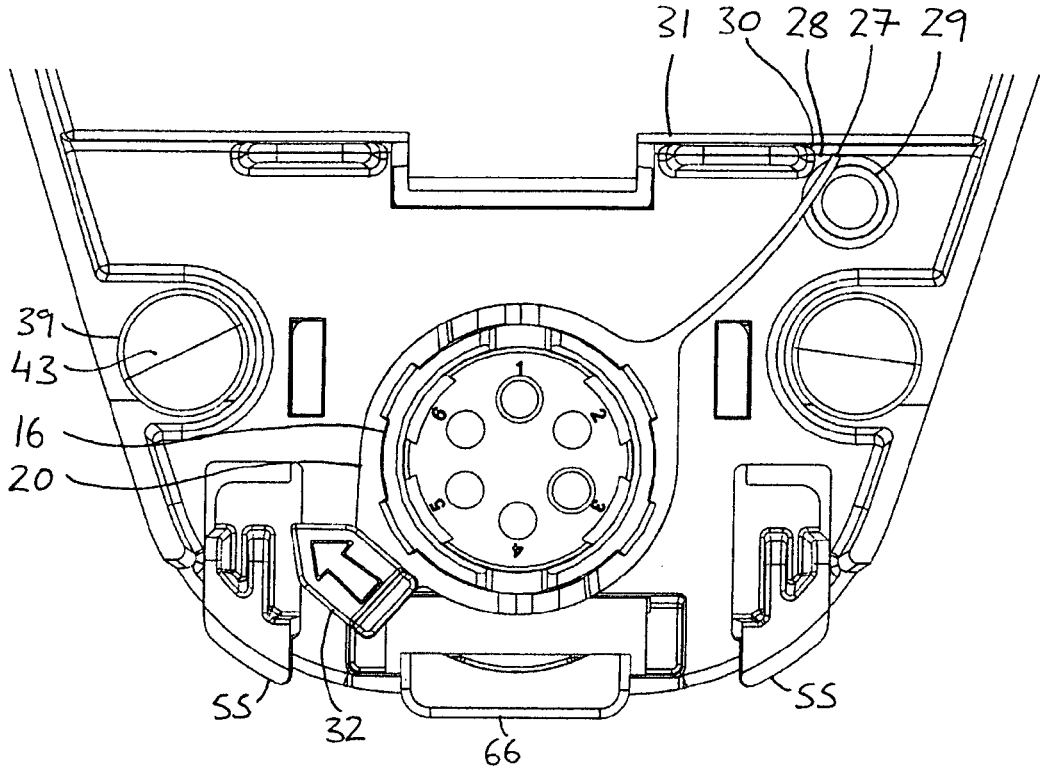
FIG. 7 is a front view of a portion of a base component of the dispensing device shown in FIG. 1.
Figure 8:
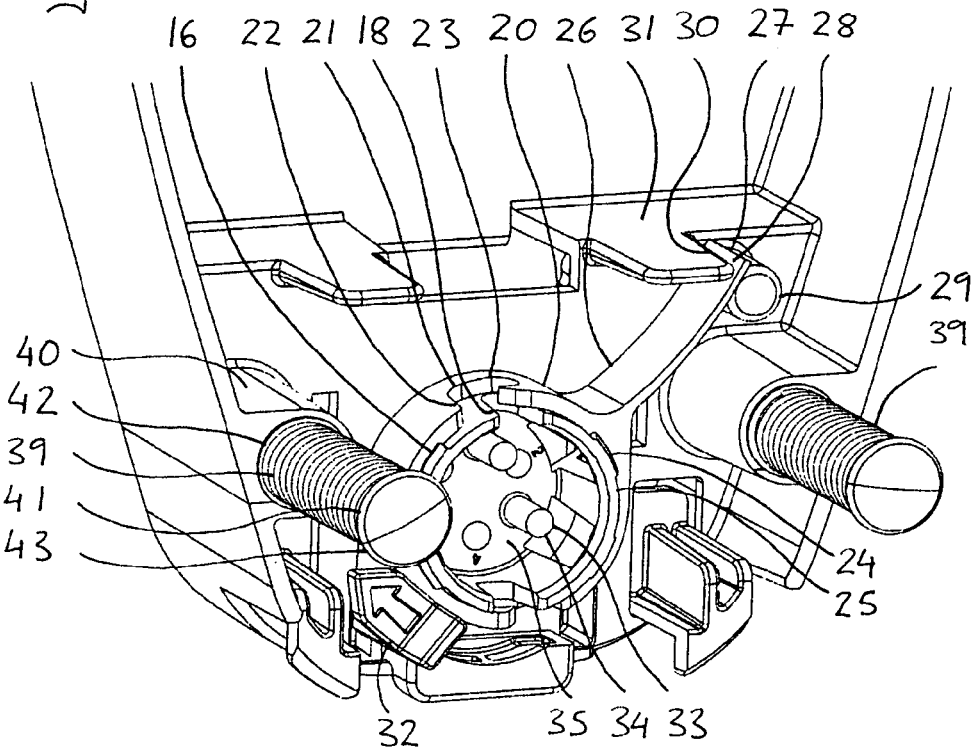
FIG. 8 is a perspective view of the portion of the base component shown in FIG. 7.

Referring now to FIGS. 5 to 8, the base 4 comprises an annular mounting socket 16, and the pump 3, which is shown in isolation in FIG. 6, comprises an annular mounting boss 17 adapted to removably mount inside said mounting socket 16.

The mounting socket 16 comprises two axially extending and open-ended slots 18, at a top and a bottom thereof, and the mounting boss 17 comprises two corresponding radially extending pins 19 which are adapted to be disposed in said slots 18 when the mounting boss 17 is mounted in the mounting socket 16. As such, the mounting boss 17 can only be mounted in the mounting socket 16 at one orientation thereof, when the pins 19 are aligned with the slots 18.

A rotatable annular locking ring 20 is mounted around the mounting socket 16, and comprises two L-shaped slots 21 at a top and a bottom thereof, which are aligned with the slots 18. The L-shaped slots 21 each comprise an open-ended axially extending inlet portion 22, and a circumferentially extending lock portion 23. The locking ring 20 is secured in position on the mounting socket 16 by tabs 24 provided at an outer end 25 of the mounting socket 16.

The locking ring 20 is rotatable on the mounting socket 16, and can be moved between an open position at which the inlet portions 22 are axially aligned with the slots 18, such that the pins 19 can be moved freely into and out of the slots 18, and a locked position in which the lock portions 23 overlie the slots 18, preventing the pins 19 from moving into or out of the slots 18.

The locking ring 20 is spring loaded against movement into the open position. The locking ring 20 comprises a radially extending leaf spring portion 26, and end of which 27 is disposed in a spring slot 28 arranged radially of the mounting socket 16. The slot 28 is defined by protrusion 29 and a part 30 of shelf 31.

When the locking ring 20 is rotated towards the open position the leaf spring portion 26 is forced into compression against the protrusion 29. The locking ring 20 comprises an activation tab 32 to facilitate its ready rotation in this manner in use.

The shelf 31 serves to support the container of liquid 15 inside the dispenser 1, when the mounting boss 17 is located in the mounting socket 16.

The mounting socket 16 comprises a first shaped profile 33 made up of one or more of a possible six studs 34, which extend from the base 35 of the mounting socket 16, and the length of each of which is a part of a pre-determined distance. The mounting boss 17 comprises a corresponding second shaped profile 36 comprising the opposite formation of studs 37, which extend from the base 38 of the mounting boss 17. The stud formation is circular, and the corresponding studs 34, 37 are numbered 1-6 in a clockwise direction.

In dispensing device 1 the first shaped profile 33 comprises three studs 34 at positions 1, 3 and 6. The studs 34 at positions 1 and 3 are a greater part of said pre-determined distance, while the stud 34 at position 6 is a lesser part of said pre-determined distance. No stud length is provided at positions 2, 4 and 5. The second shaped profile 36 comprises a mirror formation of studs 37, such that the mounting boss 17 can be fitted to the mounting socket 16.

The mounting boss 17 is a separately formed component to the rest of the pump 3, and is attached thereto by means of a clamp portion 17*a*, visible in FIG. 6. As such, a mounting boss with a differently shaped second profile can be provided relatively easily during manufacture.

Figure 3:
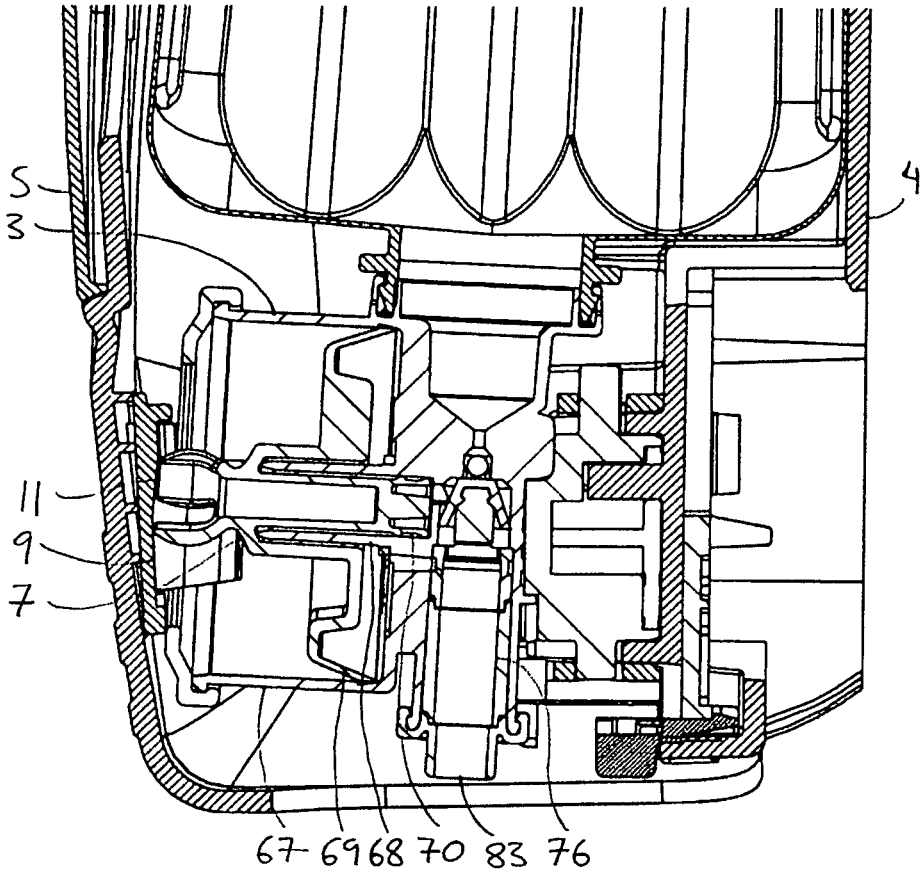
FIG. 3 is a cross-sectional side view of a portion of the dispensing device shown in FIG. 1 in a second configuration.

The base 4 is provided with a pair of spring-loaded plungers 39 arranged on either side of the pump 3. The plungers 39 each comprise a socket 40, a plunger member 41, and a coil spring 42 mounted between the socket 40 and the plunger member 41. Each plunger member 41 has a head portion 43 adapted to act against the inside surface 10 of the cover 5. In a non-compressed state the plungers 39 hold the cover 5 at its outermost point of rotation as shown in FIG. 2, and the plungers 39 must be compressed to force the cover 5 to its innermost point of rotation as shown in FIG. 3. As such, the plungers 39 act as the spring return means for the dispensing device 1, which work to automatically perform a priming stroke of the pump 3.

Figure 4:
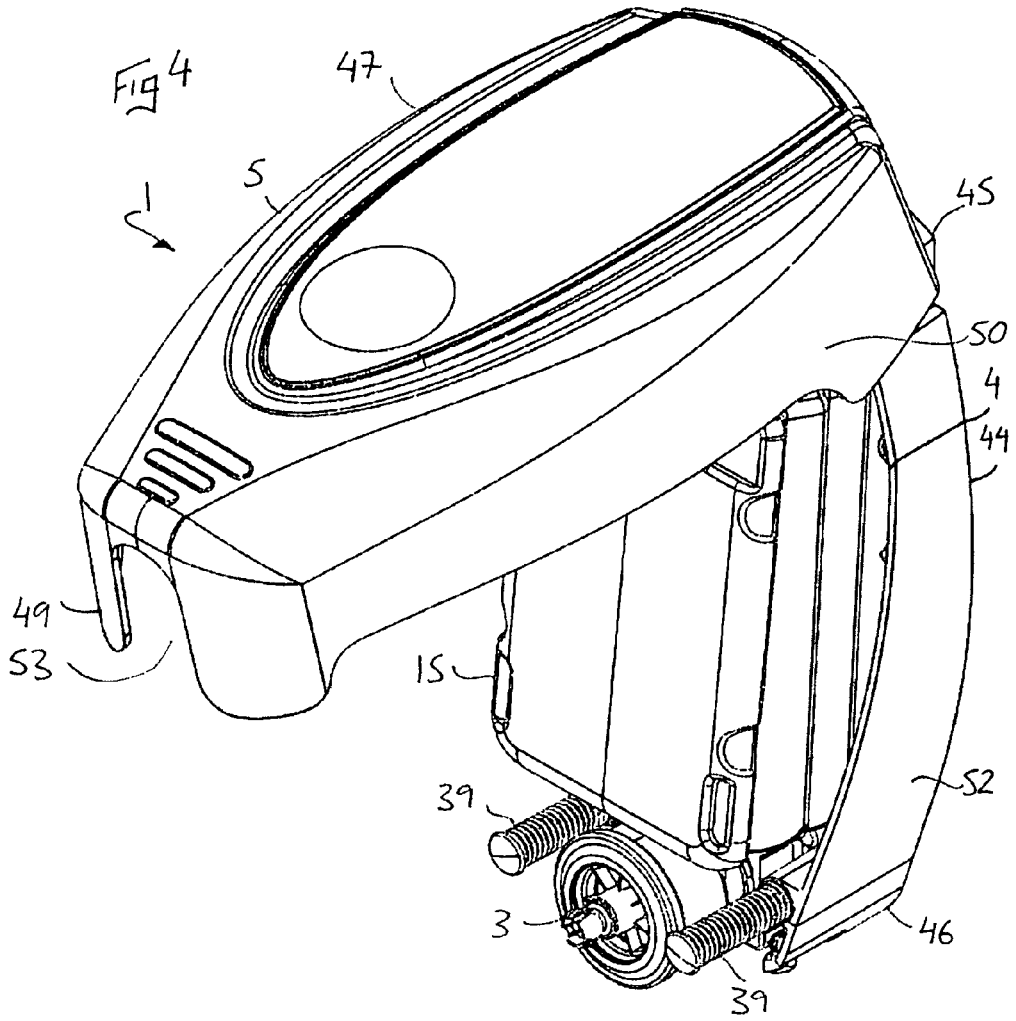
FIG. 4 is a perspective view of the dispensing device shown in FIG. 1 in a third configuration.

As is clear from FIGS. 1 and 4, the dispensing device 1 is of the type comprising a base 4 comprising a back plate 44, with a top edge 45 and a bottom edge 46, and a cover 5 comprising a face side 47 with a top side 48, bottom side 49, left side (not visible in the Figures) and right side 50 extending substantially normally therefrom. The back plate 44 also comprises a left side 51 and a right side 52 extending substantially normally therefrom. The sides 50 of the cover 5 overlap with the sides 51 and 52 of the base 4 to provide said enclosure 2. No bottom side is provided on the base 4, and the bottom side 49 of the cover 5 is provided with an aperture 53. This is to allow for form to be dispensed from out of the bottom of the dispenser 1.

The hinge 6 attaches the cover 5 to the top edge 45 of the base 4 adjacent to the top side 48 of the cover 5, and allows the cover 5 to rotate back and forth in relation to the base 4.

Figure 9:
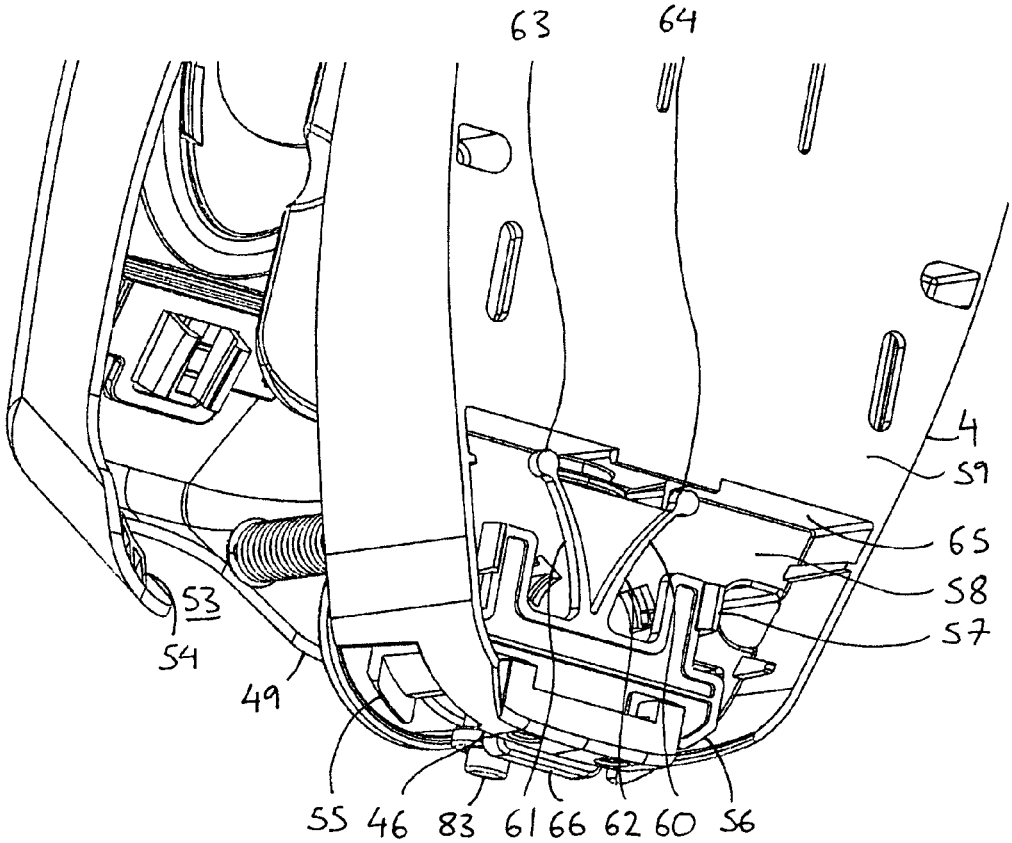
FIG. 9 is a perspective view of a portion of the dispensing device shown in FIG. 1.

Referring now to FIG. 9, the bottom side 49 of the cover 5 comprise two catches, one of which 54 is visible, on either side of the aperture 53. The base 4 comprise two corresponding spring-loaded latches 55 adjacent its bottom edge 46, which are adapted to releasably retain said catches 54 when the cover 5 reaches the outermost point of rotation shown in FIG. 2. As such, the positioning of the catches 54 and the latches 55 determines said outermost point of rotation, which corresponds to the fully primed position of the pump 3. When the latches 55 release said catches 54, the sliding member 11 can be pulled from the track 9, and the cover 5 can rotate fully away from the base 4 to allow access to the inside of the enclosure 2.

The latches 55 are provided as part of a latch body 56, which is retained in a framework 57 provided in a chamber 58 at the rear 59 of the base 4. The latch body 56 comprises a bifurcated leaf spring 60 comprising a pair of leaf spring members 61 and 62, ends of which 63 and 64 abut against a top wall 65 of the chamber 58. As such, the latches 55 are spring loaded against being moved into a catch releasing position.

The latch body 56 comprises an operating trigger 66, depression of which forces the leaf spring members 61 and 62 to move apart by sliding across the top wall 65, and which moves the latches 55 in to a catch releasing position.

Pump 3 is a foaming pump adapted to mix air and fluid together to form a foam. Referring to FIG. 2, the pump 3 comprises co-axial air and liquid cylinders 67 and 68, and the piston 13 comprises co-axial air and liquid piston portions 69 and 70. The piston portions 69 and 70 are self-sealing against the walls of the respective cylinders 67 and 68.

A valve chamber 71 is disposed at the inner end 72 of the liquid cylinder 68, which houses an inlet ball valve 73, and an outlet flange valve 74. The valve chamber 71 is disposed between an outlet 75 of the container 15, and a mixing chamber 76 of the pump 3. As such, during the priming stroke of the pump 3, the inlet ball valve 73 opens and liquid is drawn from the container 15 into the liquid cylinder 68. The outlet flange valve 74 is forced into a closed position during the priming stroke. During the dispensing stroke of the pump 3 the outlet flange valve 74 opens and the liquid in the liquid cylinder 68 is pumped into the mixing chamber 76. The inlet ball valve 73 is forced into a closed position during the dispensing stroke.

The air cylinder 67 is provided with a plurality of air inlet apertures 77 (visible in FIG. 6) at an inner end 78 thereof. A ring-shaped flange 79 is provided at the inner end 78 of the air cylinder 67, which overlies said air inlet apertures 77. An air outlet passageway 80 extends from the inner end 78 of the air cylinder 67 into the mixing chamber 76. As such, during the priming stroke of the pump 3, the flange 79 is forced away from the inner end 78 of the air cylinder 67, and air from atmosphere is drawn into the air cylinder 67 through the air inlet apertures 77. During the dispensing stroke of the pump 3 the air in the air cylinder 67 is forced through the air outlet passageway 80 and into the mixing chamber 76. The flange 79 is forced into a closed position of the air inlet apertures 77 during the dispensing stroke.

The liquid and air forced into the mixing chamber 76 during the dispensing stroke comingles, and is forced over foaming meshes 81 and 82 to form a foam. This foam is then dispensed out of the pump outlet 83.

An end cap 84 is provided over the end of the air cylinder 67 to keep the piston 13 in the pump 3.

The dispenser 1 operates as follows. To load a container of liquid 15 inside the dispenser 1 for use, the cover 5 is rotated fully away from the base 4, as shown in FIG. 4. This allows accesses to the inside of the enclosure 2.

To load a container of liquid 15, first the activation tab 32 is pushed upwards in the direction of its arrow indicator, and the locking ring 20 is rotated against the force of the leaf spring portion 26 until it reaches its open position and the inlet portions 22 are axially aligned with the slots 18.

A container of liquid 15, with its own pump 3 already attached, is then offered up to the base 4, with the mounting boss 17 aligned with the mounting socket 16. The mounting boss 17 is slotted into the mounting socket 16 with the pins 19 thereof entering the slots 18. During this action the container 15 is placed on the shelf 31.

Once the mounting boss 17 is in position the activation tab 32 is released, and the locking ring 20 is forced back into its locked position by the leaf spring portion 26. As such, the lock portions 23 overlie the slots 18, and the pins 19 are secured in the slots 18. The container of liquid 15 and its pump 3 are now mounted to the base 4, and are ready for use.

It will be appreciated that this mounting process is only possible because the first and second shaped profiles 33 and 36 correspond with one another. If this were not the case, and one or more of the stud pairings facing one another comprise a combination of lengths of stud 34, 37 which is greater than the pre-determined distance, then the mounting boss 17 would not be able to enter the mounting socket 16.

Therefore, the manufacturers of the dispenser 1 and the pump 3 can coordinate the first and second shaped profiles 33 and 36 of different items to differentiate between them, for example to ensure that containers of the correct liquid are used with the correct dispenser in instances where a number of different dispensers are used on site. If a user tries to mount a container of the wrong liquid into a particular dispenser, the shaped profiles 33 and 36 can clash, preventing that container being used.

In addition, the manufacturers of the dispenser 1 and the pump 3 can utilise the shaped profiles 33 and 36 to prevent unauthorised third party products from being used with their own. If a third party begins to manufacture containers of liquid and pumps to match an existing dispenser range, then the manufacturer of those dispensers can introduce an amended product with a different shaped profile 33, so that those unauthorised items will not fit it.

The mounting boss 17 is a separately formed part which is mounted to the pump 3 via clamp portion 17*a*. As such, it is only necessary to manufacture variations of this small part in order to provide for the above described functionality. The rest of the pump 3 can always be the same.

Once the container 15 and the pump 3 are mounted to the base 4, the cover 5 is rotated about the hinge 6 back towards the base 4, until the inside surface 10 of the cover 5 meets the head portions 43 of the plungers 39. The cover 5 is then forced against the plungers 39 until the track 9 meets the sliding member 11, and then a further force is applied to force the sliding member 11 to snap-fit into position in the track 9, as shown in FIG. 3. (If the pump 3 is in the primed position, as shown in FIG. 2, when the cover 5 is brought down, the operating plunger 7 will be depressed by the track 9 until the pump 3 is in the dully dispensed position, as shown in FIG. 3, before the sliding member 11 will snap into the track 9.)

During this process the catches 54 on the cover 5 are forced against the latches 55 on the base 4, and the latches 55 ride up and over the catches 54, against the force of the leaf spring 60. As such, the movement of the cover 5 is then restricted, and the dispenser 1 is ready for use.

To dispense a foam from the dispenser 1 the cover 5 is depressed against the plungers 39, and the rotational movement thereof is converted into a linear movement of the operating plunger 7 by the pivoting linkage 8. As the cover 5 rotates the sliding member 11 slides up the track 9 from the position shown in FIG. 2 to the position shown in FIG. 3, and at the same time moves down the piston axis A-A, such that the air and liquid pistons 69 and 70 move down the air and liquid cylinders 67 and 68 respectively, and air and liquid contained therein is forced into the mixing chamber 76, and the resulting foam is dispensed from the pump outlet 83.

When the cover 5 is released the plungers 39 act against the inside surface 10 of the cover 5, and push it back out, until the catches 54 abut against the latches 55. During this movement the sliding member 11, and therefore the piston 13, is pulled back along the piston axis A-A, forcing the pump 3 to perform a priming stroke. Again, the rotational movement of the cover 5 is converted into a linear movement by the pivoting linkage 8. The sliding member 11 slides back down the track 9 from the position shown in FIG. 3 to the position shown in FIG. 2. Simultaneously, air and liquid are drawn into the air and liquid cylinders 67 and 68, and the dispenser 1 is ready to perform another dispensing stroke.

When the container of liquid 15 is depleted it can be removed and replaced. To access the inside of the enclosure 2 the operating trigger 66 is depressed, removing the latches 55 from the path of the catches 54, and a force is applied to the cover 5 to snap the sliding member 11 out of the track 9. Once free the cover 5 can be rotated away from the base 4, as shown in FIG. 4. The activation tab 32 is then pushed upwards in the direction of its arrow indicator, and the locking ring 20 is rotated against the force of the leaf spring portion 26 until it reaches its open position and the inlet portions 22 are axially aligned with the slots 18. The mounting boss 17 can then be freely removed from the mounting socket 16, and the container 15 and its pump 3 can be removed from the dispenser 1, and disposed of.

The dispenser described above can be altered without departing from the scope of claim 1. For example, in other alternative embodiments the pump 3 can be a liquid pump, or a spray pump, as opposed to a foaming pump.

Figure 10:
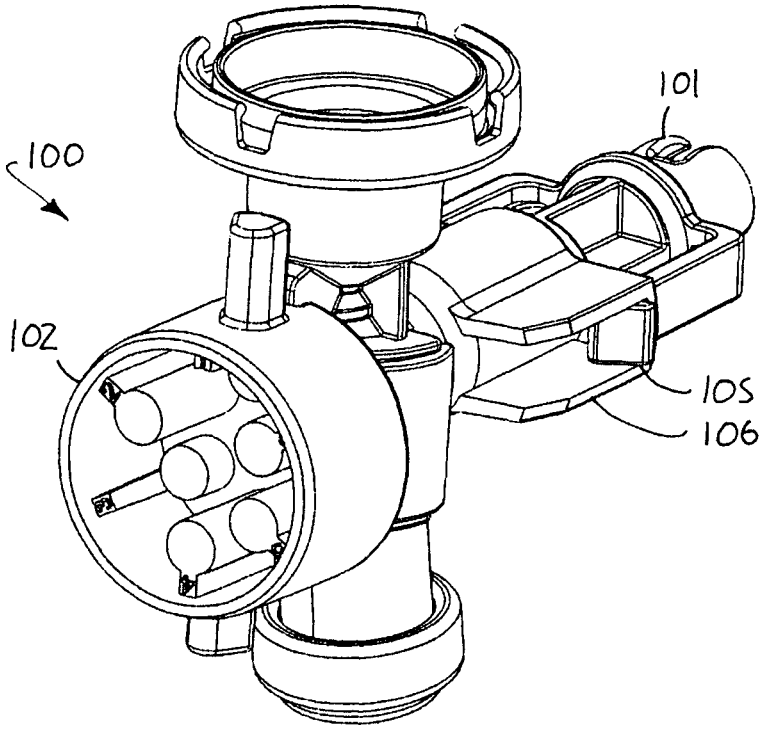
FIG. 10 is a perspective view of a second pump component for the dispensing device shown in FIG. 1.
Figure 11:
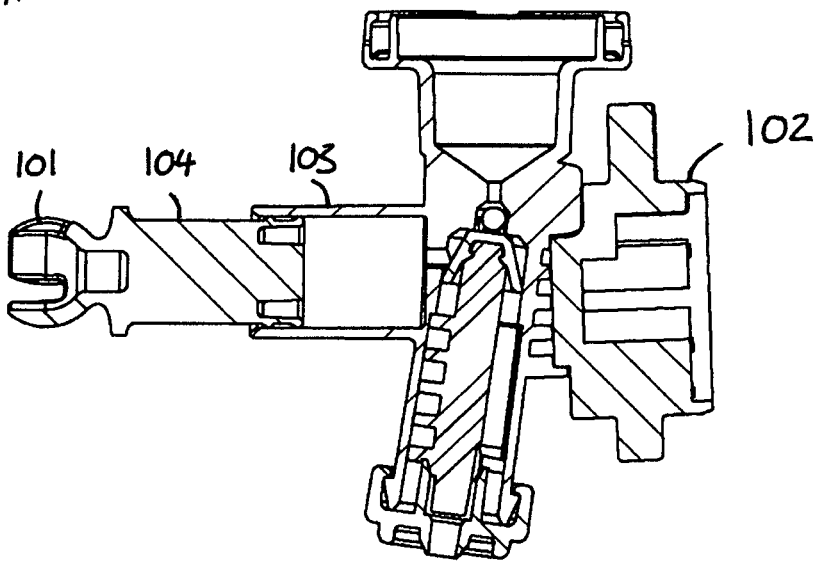
FIG. 11 is a cross-sectional side view of the pump component shown in FIG. 10.

FIGS. 10 and 11 show an example of a liquid pump 100 which can be employed as an alternative to the foaming pump 3. As with the above described embodiment, the liquid pump 100 would be attached to a container of liquid to be dispensed (not shown), and would be disposed of with that container after use. Externally the liquid pump 100 has the same interfaces with the base 4 and the cover 5 as pump 3 described above, in the form of sliding member 101, and mounting boss 102. As such, it can be used with an enclosure 2 identical to that described above.

However, as a device for dispensing only liquid directly from the container, liquid pump 100 comprises only a liquid cylinder 103 and no air cylinder. In order to prevent the piston 104 from leaving the cylinder 103 external barbs 105 are provided which co-operate with channels 106 provided on the walls of the pump 100.

Figure 12:
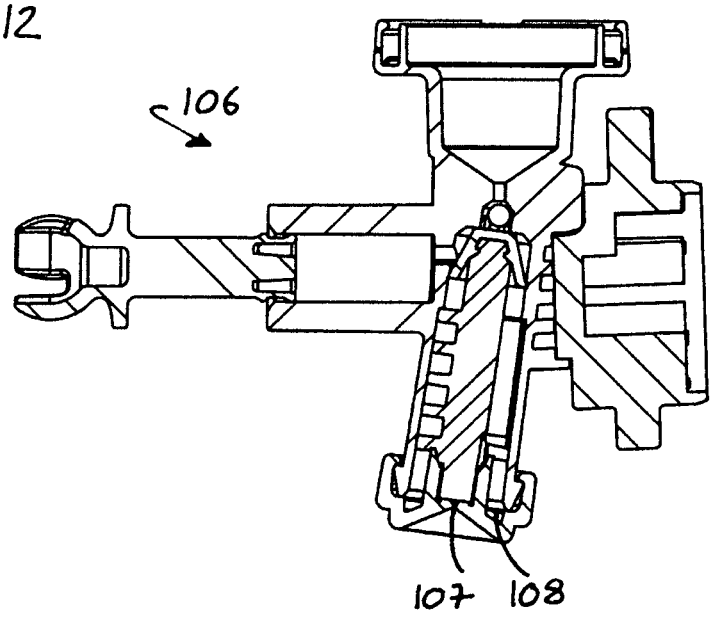
FIG. 12 is a cross-sectional side view of a third pump component for the dispensing device shown in FIG. 1.

FIG. 12 shows a further variation of pump, which this time is a spray pump 106. This pump is the same as liquid pump 100 described above, except that it dispenses a spray of liquid. This is achieved by interposing spray aperture 107 at the pump outlet 108.

Other alterations to the dispenser 1 described above are also possible. In another alternative embodiment (not shown) the pivoting linkage is reversed, with a sliding member being provided on the inside surface of the cover, and a track being provided on the operating plunger of the pump.

Thus, the present invention provides a dispenser in which the cover is provided with spring return means, and its movement in both an inward and an outward direction moves the operating plunger in both the dispensing and priming strokes. As such, a simple pump can be used which does not comprise a spring return means, which reduces its complexity over known designs and allows it to become viably disposable.

The invention claimed is:

1. A dispensing device comprising an enclosure and a pump, in which the enclosure comprises a base and a cover, in which the cover is attached to the base with a hinge and is rotatable about said hinge towards and away from said base, in which the pump comprises an operating plunger, in which the cover is connected to said plunger by a pivoting linkage adapted to convert the rotational movement of the cover into a linear movement of the operating plunger, and in which the cover is connected to said plunger in a retained manner so movement of the cover in both an inward and an outward direction moves the operating plunger in both dispensing and priming strokes thereof respectively.

2. A dispensing device as claimed in claim 1 in which the pivoted linkage comprises a track and a sliding member disposed in said track and adapted to slide back and forth therein according to the rotational movement of the cover.

3. A dispensing device as claimed in claim 2 in which the cover comprises said track, and in which the plunger comprises said sliding member.

4. A dispensing device as claimed in claim 3 in which the track defines a straight path, in which the track is curved in a plane normal to said path.

5. A dispensing device as claimed in claim 4 in which the sliding member is releasably disposed in said track.

6. A dispensing device as claimed in claim 5 in which the sliding member is substantially ball-shaped, and in which the track comprises a substantially annular cross-section adapted to retain the sliding member therein.

7. A dispensing device as claimed in claim 6 in which a piston of said pump is provided at an inner end of the operating plunger, in which a centre of the sliding member is aligned with an axis of the piston, in which the sliding member comprises a hollow partial-sphere which is delimited by a plane normal to the piston axis, and in which the sliding member comprises a plurality of circumferentially extending intervals parallel to the piston axis.

8. A dispensing device as claimed in claim 1 in which the pump is connected to a container of fluid to be dispensed which is mounted in the enclosure, and in which the pump is releasably mounted to said base.

9. A dispensing device as claimed in claim 8 in which the base comprises an annular mounting socket, in which the pump comprises an annular mounting boss removably disposed in said mounting socket, in which the mounting socket comprises one or more axially extending and open-ended slots, in which the mounting boss comprises one or more corresponding radially extending pins disposed in said slots, in which a rotatable locking ring is mounted around the mounting socket, in which the locking ring is provided with one or more L-shaped slots comprising an open-ended axially extending inlet portion and a circumferentially extending lock portion, in which in an open position said inlet portions are aligned with the slots of the mounting socket, in which in a locked position said lock portions are aligned with the slots of the mounting bracket, and in which the locking ring is spring loaded against movement into the open position.

10. A dispensing device as claimed in claim 9 in which the base comprises a spring slot disposed radially of the mounting socket, in which the locking ring comprises a radially extending leaf spring portion, an end of which is mounted in said spring slot, thereby to bias the locking ring against movement into the open position, and in which the locking ring comprises an activation tab.

11. A dispensing device as claimed in claim 10 in which the base of the mounting socket comprises a first shaped profile, and in which the mounting boss comprises a corresponding second shaped profile adapted to interface with the first shaped profile.

12. A dispensing device as claimed in claim 11 in which the first shaped profile comprises a plurality of studs, the length of each of which is a part of a pre-determined distance, in which the second shaped profile comprises a plurality of corresponding studs, the length of each of which comprises the corresponding remaining part of said pre-determined distance.

13. A dispensing device as claimed in claim 1 in which the base is provided with spring-return means, which spring return means act to rotate the cover away from said base.

14. A dispensing device as claimed in claim 13 in which the spring return means comprises a pair of spring-loaded plungers arranged on either side of the pump.

15. A dispensing device as claimed in claim 1 in which the base comprises a back plate with a top edge and a bottom edge, in which the cover comprises a face side with a top side, bottom side, left side and right side extending substantially normally therefrom, in which the hinge attaches the cover to the top edge of the base adjacent to the top side of the cover, in which the bottom side of the cover comprises one or more catches, in which the base comprises one or more corresponding spring-loaded latches adjacent its bottom edge adapted to releasably retain said catches when the cover reaches an outermost point of rotation.

16. A dispensing device as claimed in claim 15 in which the spring loaded latches are provided as part of a latch body retained in a framework provided in a chamber in said base, in which said latch body comprises a bifurcated leaf spring comprising a pair of leaf spring members, ends of which abut against a top wall of said chamber, such that the latches are spring loaded against being moved into a catch releasing position, and in which the latch body comprises an operating trigger, depression of which forces the leaf spring members to move apart by sliding across the top wall, and which moves the latches into said catch releasing position.

17. A dispensing device as claimed in claim 1 in which the pump is a foam pump adapted to mix air and fluid together to form a foam.

18. A dispensing device as claimed in claim 1 in which the pump is a liquid pump adapted to dispense a liquid.

19. A dispensing device as claimed in claim 18 in which the pump is a liquid spray pump adapted to dispense said liquid as a spray.

* * * * *